US006865985B2

(12) United States Patent
Zheng

(10) Patent No.: US 6,865,985 B2
(45) Date of Patent: Mar. 15, 2005

(54) FOLDABLE PANEL SUPPORTER

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 130 days.

(21) Appl. No.: 10/318,647

(22) Filed: Dec. 16, 2002

(65) Prior Publication Data

US 2004/0112263 A1 Jun. 17, 2004

(51) Int. Cl.[7] ..... A47B 3/00
(52) U.S. Cl. ..... 100/127; 100/132
(58) Field of Search ..... 108/132, 133, 108/127, 115; 248/188.6

(56) References Cited

U.S. PATENT DOCUMENTS

| | | | | |
|---|---|---|---|---|
| 1,300,861 A | * | 4/1919 | Otte | 108/131 |
| 1,309,774 A | * | 7/1919 | Otte | 108/131 |
| 2,707,664 A | * | 5/1955 | Mac | 108/127 |
| 2,708,145 A | * | 5/1955 | Anderson et al. | 108/127 |
| 2,823,087 A | * | 2/1958 | Zimmer | 108/18 |
| 2,977,169 A | * | 3/1961 | Geller | 108/19 |
| 4,065,086 A | * | 12/1977 | Nakao | 248/188.6 |
| 4,557,200 A | * | 12/1985 | Geschwender | 108/132 |
| 5,367,962 A | * | 11/1994 | Tseng | 108/127 |
| 6,561,107 B1 | * | 5/2003 | Wood et al. | 108/132 |

FOREIGN PATENT DOCUMENTS

| | | | | |
|---|---|---|---|---|
| GB | 2064949 A | * | 6/1981 | A47B/83/02 |

* cited by examiner

*Primary Examiner*—Jose V. Chen
(74) *Attorney, Agent, or Firm*—Raymond Y. Chan; David and Raymond

(57) ABSTRACT

A foldable panel supporter includes a supporting leg frame and a supporter joint, wherein the supporting leg frame includes a lower supporting frame and an upper connecting frame which includes a pair of L-shaped resilient connecting arms adapted for being inwardly and slightly pressed. The supporter joint has a folding channel provided thereon to receive the two connecting arms of the upper connecting frame, wherein the folding channel has two holding portions at two ends thereof and a retaining portion extending between the two holding portions. The retaining portion has a width narrower than the two holding portions, wherein each of the holding portions is shaped and sized to receive the connecting arms therein, wherein by slightly and inwardly pressing the resilient connecting arms to an extent that a distance between the resilient connecting arms is equal to the width of the retaining portion, the upper supporting frame is capable of sliding form one of the holding portion to another the holding portion.

16 Claims, 5 Drawing Sheets

FOLDABLE PANEL SUPPORTER

BACKGROUND OF THE PRESENT INVENTION

1. Field of Invention

The present invention relates to a supporter, and more particularly to a foldable panel supporter which is capable of securely supporting a panel of various sizes and shapes when it is unfolded, and bending into a very compact size when it is utterly folded.

2. Description of Related Arts

Utilizing panels of various kinds, such as tabletops, have been supported by different ways, such as foldable legs, at an elevated level to perform different functions. Conventional examples of such kinds of panel-supports structures include tables, foldable chairs and the likes.

As an illustration, a conventional foldable table usually comprises a tabletop, a plurality of leg frames, each comprising at least a supporting leg, foldably mounted on a bottom surface of the tabletop in such a manner that they are capable of moving into a folded position and an unfolded position, wherein in the unfolded position, the leg frames are fully stretched and extended to stand on the ground so as to securely support the tabletop at elevated level with respect to the ground, wherein in the folded position, the leg frames are inwardly and pivotally folded towards the tabletop.

Several disadvantages of such conventional panel-support structures are described hereinafter.

First, the conventional panel-support structures are usually bulky even after completely folded. For a conventional domestic foldable table, when it is folded, the tabletop will be vertically and suspendedly supported by the leg frames which extend from the bottom surface of the tabletop to the ground on which the foldable table stands. On one hand, most of the leg frames of the conventional foldable tables possess considerable thickness. On the other hand, a substantial portion of each of the leg frames extends between the ground and the tabletop. Therefore, it is a bulky foldable table and is inconvenient to store. Though they are foldable, they are still difficult to transport.

Second, because most of the foldable tables are designed to stand on the ground when they are folded, they possess potential danger to people, especially children who may somehow be accidentally tripped by the supporting legs. If this is the case, the children may involve risk and be hit by the falling table. In addition, the weight of the foldable table is usually significant to most children and thus the consequence of which can be disastrous.

Third, for some foldable banquet tables, each of the leg frames is adapted to be pivotally and inwardly folded or unfolded about an axis which is parallel to an transverse edge of the tabletop, wherein when utterly unfolded, the leg frames are folded towards and bias against the bottom surface of the tabletop, with each of the leg frames occupies about half of the total length of the tabletop. Due to this inherent physical nature of such foldable tables, the height of the foldable table is, in engineering's terms, a function of the length of the tabletop which has then to seek balance with the width thereof to maintain a reasonable shape of the tabletop, say a rectangular shape. Thus, the greater the height of the leg frames, generally, the larger the tabletop.

Fourth, for almost all conventional foldable tables, each of which usually comprises retaining means for securely retaining the leg frame in its unfolded position. The retaining means usually comprises a plurality of retaining members, usually elongated in shape, mounted on the leg frame in a pivotally foldable manner to restrict a folding range of the leg frame. From engineering point of view, the retaining elements are deemed essential in accomplishing the function of directing the folding range of the leg frame and, at the same time, securely retaining the leg frames in unfolded position so as to provide secure support to the tabletop. The extent to which these retaining members incur additional complexity to the structure of the foldable table and increase the overall weight of the foldable table should be recognized and cannot be overlooked as a disadvantage of the conventional foldable tables.

SUMMARY OF THE PRESENT INVENTION

A main object of the present invention is to provide a foldable panel supporter comprising a supporting leg frame which is capable of being pivotally either unfolded to securely support a panel mounted thereon or folded toward the panel to form a compact structure as compared with conventional arts.

Another object of the present invention is to provide a foldable panel supporter wherein the supporting leg frame is adapted to be folded diagonally with respect to the panel so as to maximize the length of the supporting leg frame for a given panel. In other words, the height at which the panel can be supported by the pane supporter with respect to the ground can be maximized.

Another object of the present invention is to provide a foldable panel supporter which neither involves complicated mechanical components nor operational procedures so as to minimize the manufacturing cost as well as the overall weight of the present invention. In other words, when it is incorporated with a panel, the portability of the whole structure can be improved.

Another object of the present invention is to provide a foldable panel supporter which comprises a base joint and the supporting leg frame, wherein the supporting leg frame is detachably and foldably mounted on the base joint so that the supporting leg frame can be selectively replaced by another supporting leg frame of different length. In other words, the elevation at which the panel is supported can be selectively adjusted for different circumstances.

Another object of the present invention is to provide a foldable panel supporter wherein the supporting leg frame is capable of being substantially retained in the folded position and the unfolded position without involving additional mechanical components.

Another object of the present invention is to provide a foldable panel supporter which is light in weight, simple in structure, easy to assemble and flexible in function in order to maximize its rage of applications and provide optimal support to a panel.

Accordingly, in order to accomplish the above objects, the present invention provides a foldable panel supporter, which comprises:

a supporting leg frame which comprises a lower supporting frame and an upper connecting frame, wherein the upper connecting frame comprises a pair of L-shaped resilient connecting arms adapted for being inwardly and slightly pressed;

a supporter joint which has a folding channel provided thereon, wherein the folding channel has two holding portions at two ends thereof and a retaining portion extending between the two holding portions, wherein the retaining portion has a width narrower than the two holding portions, wherein each of the holding portions is shaped and sized to receive the connecting arms therein, wherein by slightly and inwardly pressing the resilient connecting arms to an extent that a distance between the resilient connecting arms is equal to the width of the retaining portion, the upper supporting frame is capable of sliding form one of the holding portion to another the holding portion; and means for retaining the upper connecting frame in the folding channel of the supporting joint in a pivotally foldable manner so as to pivotally connect the supporting leg frame with the supporting joint together, wherein the retaining portion which is narrower than the holding portions of the folding channel prevents the upper connecting frame of the supporting leg frame from sliding back from one of the holding portion to another the holding portion along the folding channel unless a compression force is applied to move the two connecting arms together.

DETAILED DESCRIPTION OF THE PREFERRED EMBODIMENT

Figure 1:
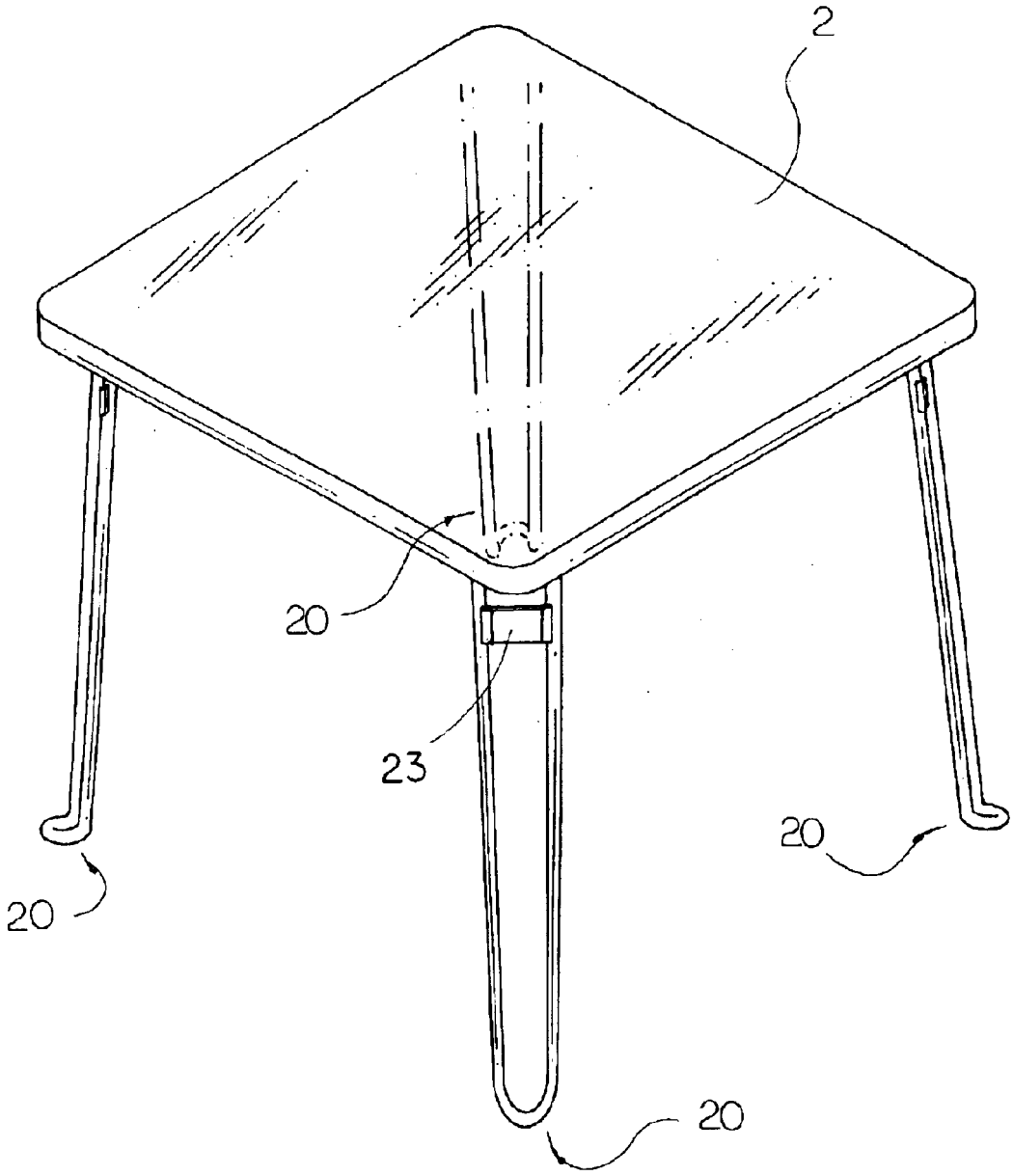
FIG. 1 is a perspective view of four foldable panel supporters incorporated with a flat panel according to a preferred embodiment of the present invention.
Figure 2:
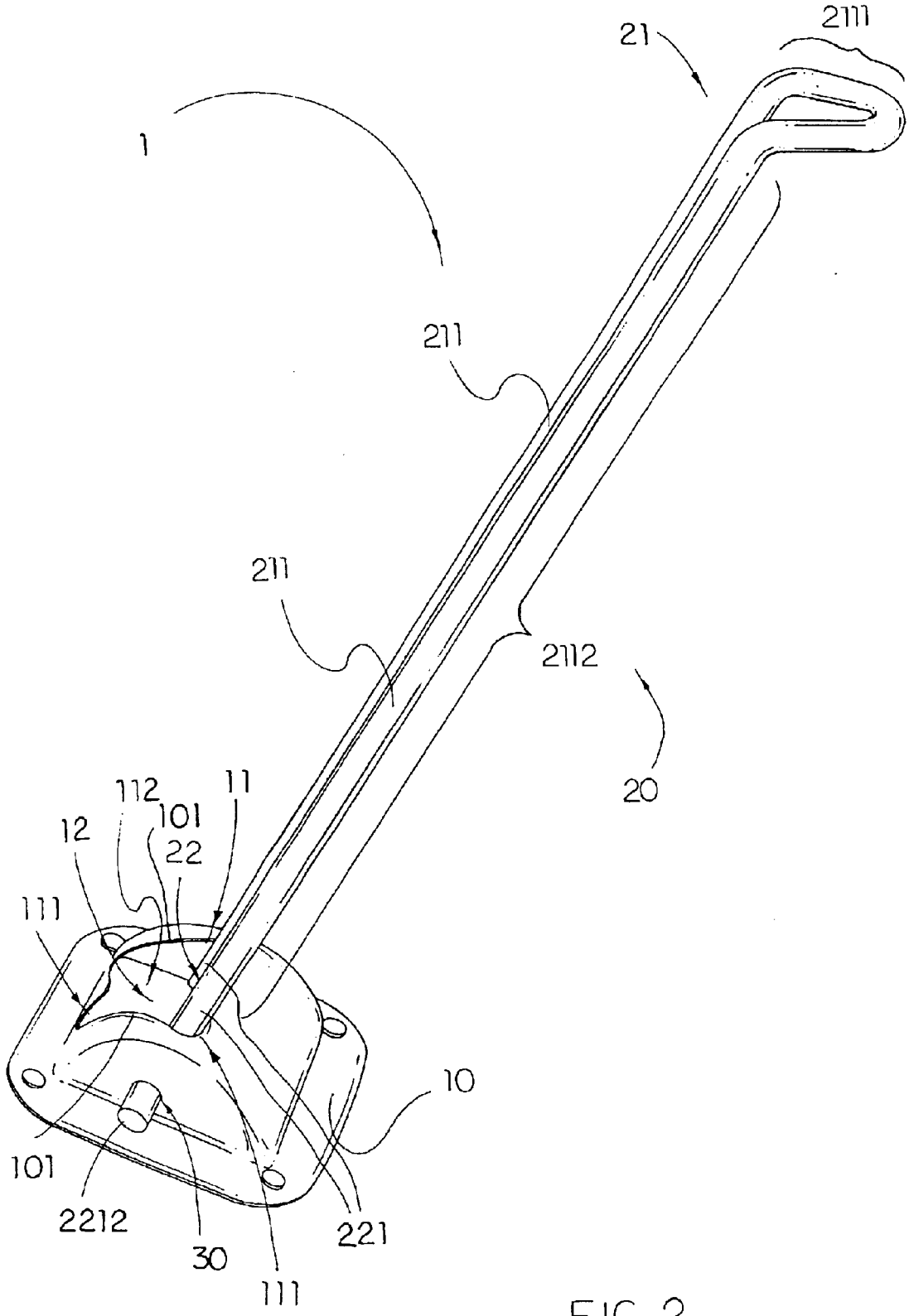
FIG. 2 is a perspective view of a foldable panel supporter according to the above preferred embodiment of the present invention.
Figure 4A:
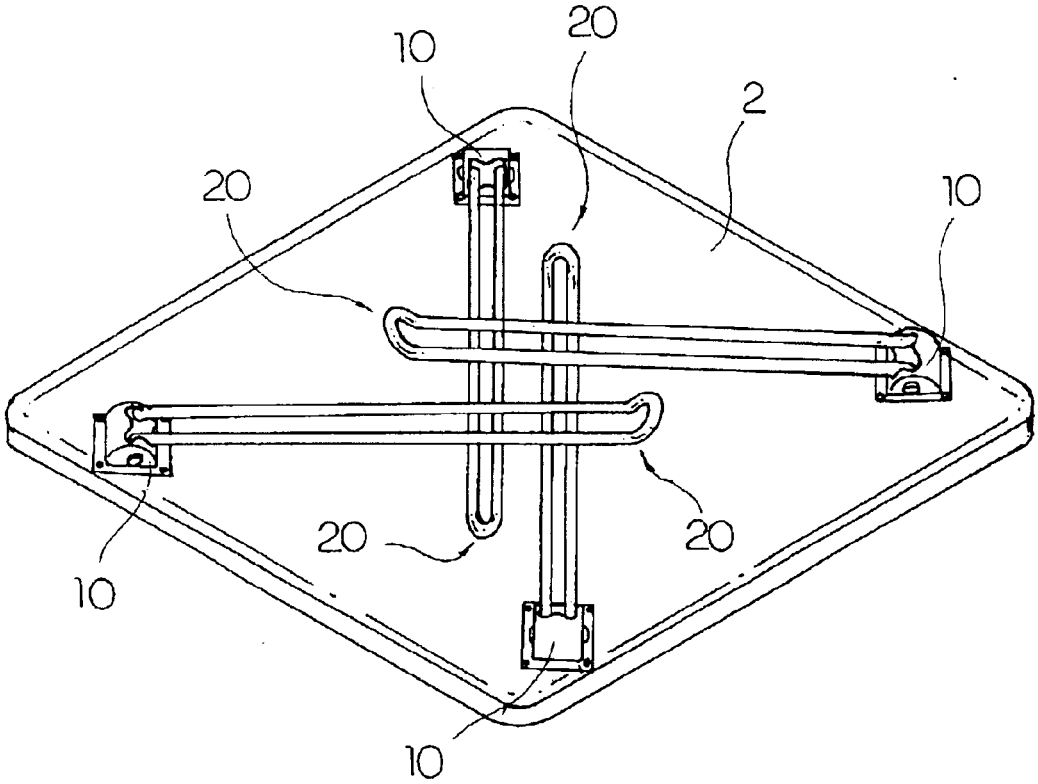
FIGS. 4A and 4B are schematic diagrams of the foldable panel supporters according to the above preferred embodiment of the present invention, illustrating, respectively, the support leg frames are in folded position and in unfolded position.
Figure 4B:
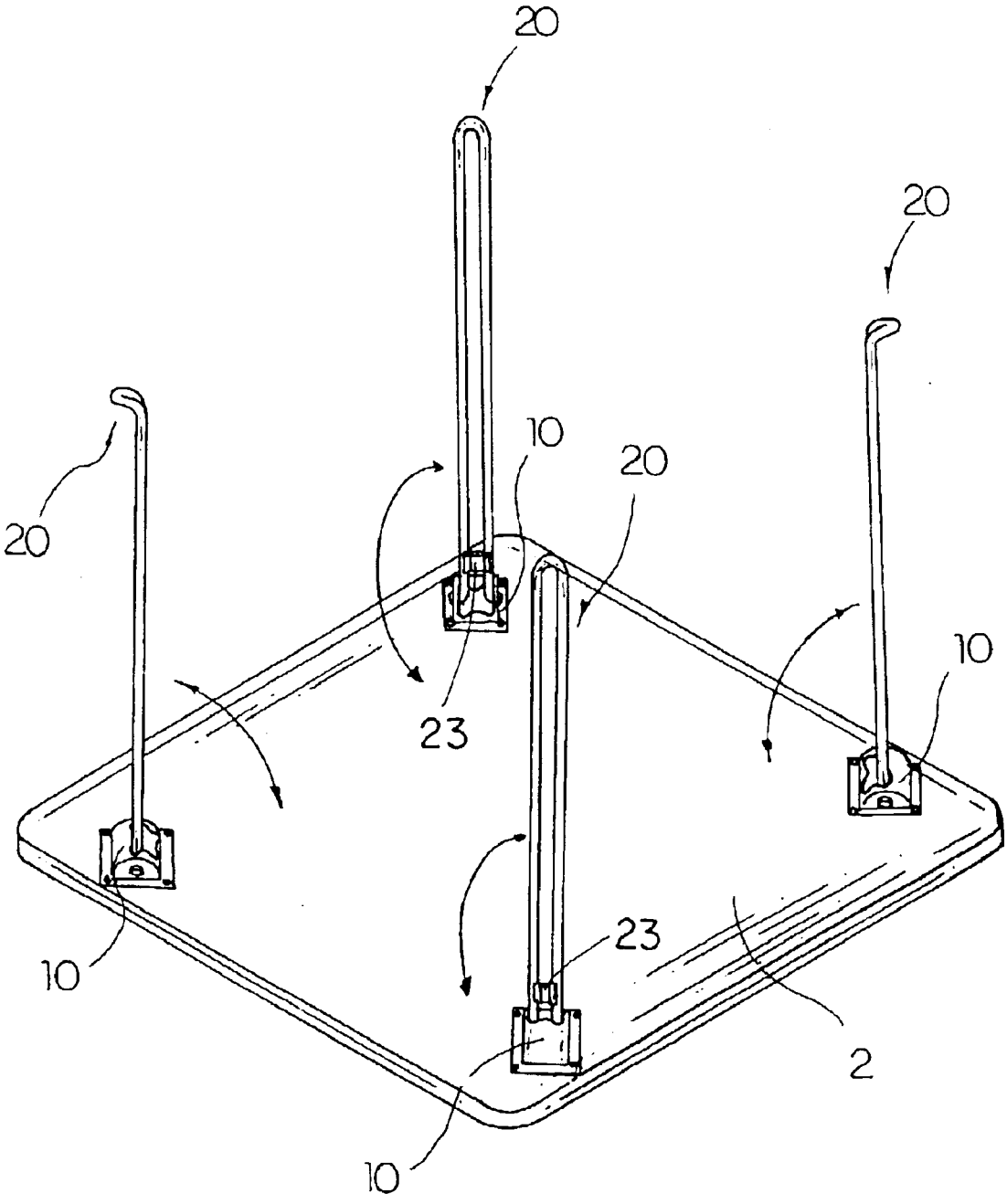

Referring to FIGS. 1 to 2 of the drawings, four foldable panel supporters 1 incorporated with a specific panel 2, such as a tabletop, to form a panel support arrangement according to a preferred embodiment of the present invention is illustrated. According to the first preferred embodiment, each of the foldable panel supporters 1 comprises a supporter joint 10 affixed to a bottom surface of the panel 2 (as shown in FIGS. 4A and 4B) and a supporting leg frame 20 adapted for pivotally connected to the supporter joint 10. Note that, albeit embodied as supporting a tabletop, the foldable panel supports 1 can be embodied as supporting flat panels of a variety of shapes and sizes.

The supporting leg frame 20 comprises a lower supporting frame 21 and an upper connecting frame 22. The lower supporting frame 21 comprises a pair of supporting legs 211 each having a standing leg portion 2111 and a linkage portion 2112 wherein the respective standing leg portions 2111 of the supporting legs 211 are integrally connected with each other and arranged to be bent at an inclination with the linkage portion 2112 to define a base stand of the supporting leg frame 20.

Figure 3:
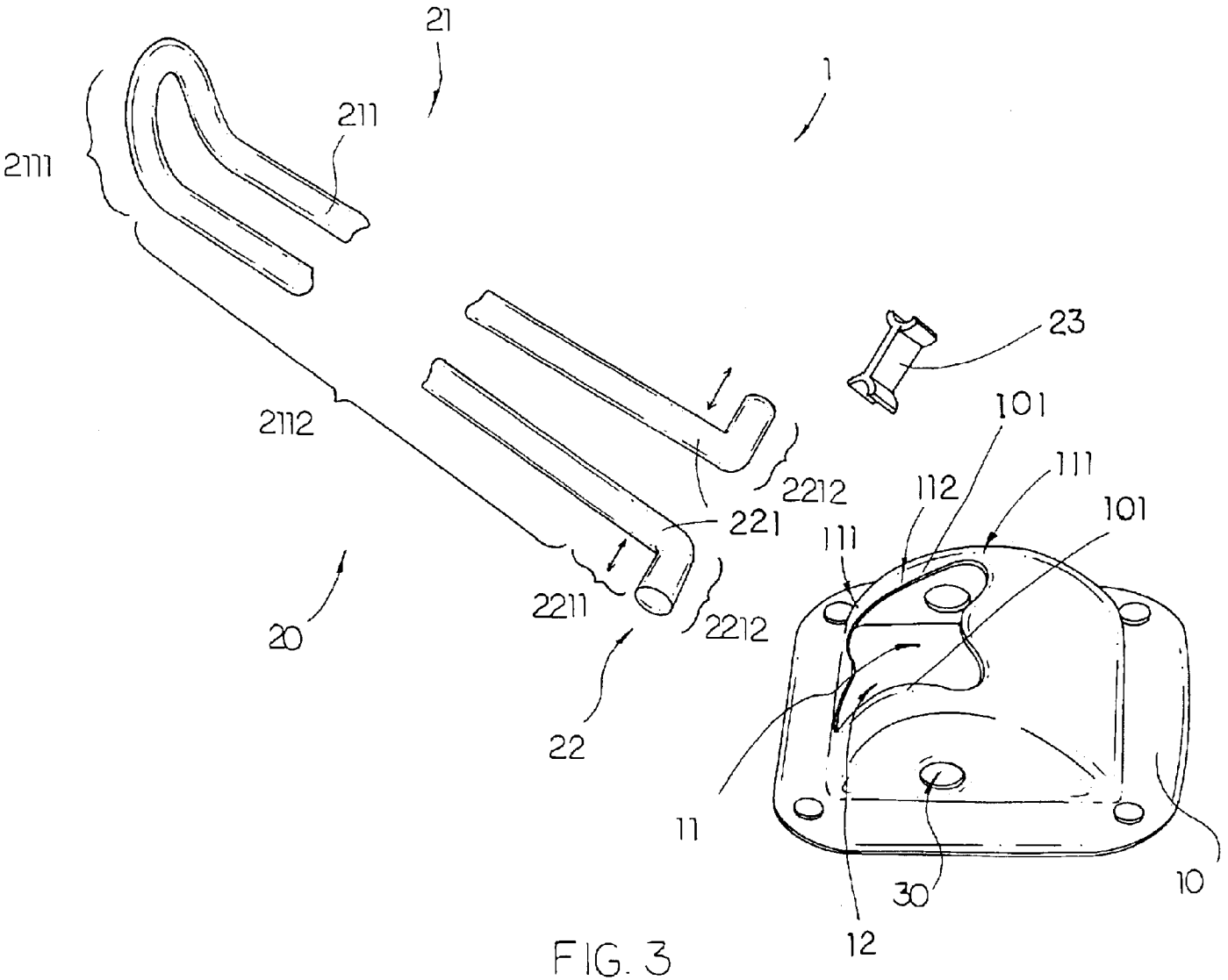
FIG. 3 is an exploded perspective view of the foldable panel supporter according to the above preferred embodiment of the present invention.

Referring to FIGS. 2 to 3 of the drawings, the upper connecting frame 22 comprises a pair of resilient connecting arms 221 separated at a predetermined separation distance x wherein each of the connecting arms 221 has a longitudinal portion 2211 and a transverse portion 2212 transversely, integrally and outwardly extended from the longitudinal portion 2211, wherein the transverse portion 2212 is arranged to be bent perpendicularly to the longitudinal portion 2211 to form a L-shaped connecting arm 221. Furthermore, the longitudinal portions of the pair of connecting arms 221 are integrally connected with the linkage portions 2112 of the pair of supporting legs 211 respectively.

It is worth to mention that the pair of connecting arms 221 is preferably constructed in a resilient manner or made of resilient material, such that the pair of connecting arms 221 is capable of being pressed slightly and inwardly and retaining to its original shape and position when such pressing force is relieved. In other words, when such pressing force is applied to the upper connecting frame 22, a distance between the outer ends of the transverse portions of the connecting arms 221 is reduced. And, if the pressing force is relieved, the connecting arms 221 will restore to their original condition.

The supporter joint 10 has a receiving cavity 12 and a folding channel 11 formed thereon to communicate the receiving cavity 12 to outside, wherein the folding channel 11 has two holding portions 111 at two ends and a retaining portion 112 extending between the two holding portions 111, wherein the retaining portion 112 has a width narrower than the two holding portions 111 according to the preferred embodiment.

Referring to FIGS. 3, 4A and 4B of the drawings, the supporting leg frame 20 is arranged to be mounted on the supporter joint 10 in a pivotally foldable manner through the folding channel 11. Specifically, in order to receive the supporting leg frame 20 into the supporter joint 10, the connecting arms 221 of the upper connecting frame 22 are slightly and inwardly pressed such that the distance between the outer ends of the transverse portions 2212 of the connecting arms 221 substantially equal the width of the holding portion 111 of the folding channel 11. Accordingly, the connecting arms 221 of the upper connecting frame 22 can be inserted into the receiving cavity through the folding channel 11 in such a manner that the connecting arms 221 of the upper connecting frame 22 are capable of sliding between the two holding portions along the folding channel 11.

The folding channel 11 is defined between two arc-shaped side walls 101 of the supporter joint 10, wherein the middle portions of the two side walls 101 are closest with each other so as to define a narrowest mid-portion of the retaining portion 112 which two ends gradually increases the width thereof to the two holding portions 111 to form the folding channel 11. Therefore, when the two connecting arms 221 is positioned at either holding portions 111, the supporting leg frame 20 is retained in position because the two arc-shaped side walls 101, i.e. the retaining portion 112 of the folding channel 11, substantially prevent the two connecting arms 221 from moving towards the retaining portion 112 unless a compression force is applied to move the two connecting arms 221 together.

The foldable panel support 1 of the present invention further comprises means for retaining the upper connecting frame 22 of the supporting leg frame 20 at the holding portions 111 of the folding channel 11 in a pivotally foldable manner. According to the preferred embodiment, the retaining means contains two holding holes 30 formed at two outer sides of said supporter joint 10 and communicated with the receiving cavity 12, wherein the transverse portion 2212 of the connecting arms 221 are arranged to extend out of the supporter joint 10 through the two holding holes respectively so as to pivotally mount the supporting leg frame 20 on the supporter joint 10.

Note that the retaining means can alternatively be embodied as a pair of holders, each having a holding hole formed thereon, attached at two inner sidewalls of the folding channel 11 respectively wherein the transverse portion of the connecting arms 221 are arranged to insert into the holding hole of the holder so as to retain the upper connecting frame 22 in the retaining portion of the channel in a pivotally movable manner.

According to the preferred embodiment, it is preferred to arrange that the distance between the two connecting arms 221 is made wider than the width of either holding portion 111 of the folding channel 11, so that the two connecting arms 221 of the upper connecting frame 22 which is inserted into the receiving cavity 12 are pressed towards each other at either holding portion 111. On the other hand, the two connecting arms 221 will press against the two ends of the respective holding portion 111 that also helps to retain the upper connecting frame 22 at such holding portion 111. In addition, the narrower width of the retaining portion of the folding channel 11 normally prevents the upper connecting frame 22 of the supporting leg frame 20 from sliding back from one holding portion 111 to another holding portion 111 along the folding channel 11. In other words, due to the resilient nature of the upper connecting frame 22, the outwardly pressing force of the connecting arms 221 with respect to the narrower holding portion 111 as well as the retaining ability achieved by the retaining portion 112, the upper connecting frame 22 is firmly locked up in the respective holding portion of the folding channel 11 unless the supporting leg frame 20 is rotated from a folded position to an unfolded position or vise verse that the two connecting arms 221 are being pressed towards each other by the two arc-shaped side walls 101 while passing through said retaining portion 112.

In order to further enhance the stability and rigidity of the foldable panel supporter of the present invention, the supporting leg frame 20 further comprises a locking member 23 to be mounted thereon in such a manner that it is capable of restricting any inward lateral movement of the connecting arms 221 so as to prevent the connecting arms 221 from being pressed and subsequently sliding back to the retaining portion 112 of the foldable channel 11. According to the preferred embodiment as shown in FIGS. 1, 3 and 4B, the locking member 23 is an I-shaped body having two ends adapted and constructed to be biased against the two connecting arms 221 so as to restrict the distance between the two connecting arms 221. Therefore, the two connecting arms 221 of the upper connecting frame 22 are blocked to be pressed towards each other. In other words, the upper connecting frame 22 is locked in position.

According to the preferred embodiment, the angle between the two holding portions 111 with respect to the holding hole 30 is 90 degrees, wherein the first holding portion 111 is adjacent to a base of the supporter joint 10 and the second holding portion 111 is positioned at a peak of the supporter joint 10. Accordingly, when four supporter joints 10 are affixed to a bottom surface of a panel 2 to form the panel support arrangement, as shown in FIGS. 4A and 4B of the drawings, each of the supporting leg frames 20 is capable of pivotally moving between the folded position and the unfolded position. In the unfolded position, the supporting leg frame 20 is pivotally extended and retained at the second holding portion 111 of the folding channel 11 so as to extend perpendicularly from the panel 2, as shown in FIGS. 1 and 4B. In the folded position, the supporting leg frame 20 is pivotally folded inwardly towards the panel 2 and retained at the first holding portion 111 of the folding channel 11 so as to overlap with the panel 2 to save space, as shown in FIG. 4A. Note that the supporter joint 10 is preferably arranged to be oriented in such a manner that the supporting leg frame 20 is arranged to be folded and unfolded along the a diagonal of the panel 2, instead of parallel to the edges of the panel 2, as in the case of most conventional foldable tables.

It is apparent that the inclination of each of the supporting leg frames 20 with respect to the panel 2 is determined by the length of the folding channel 11, i.e. the angle between the first and second holding portions 111 with respect to the holding hole 30.

Thus, in order to fold the supporting leg frame 20 from the unfolded position to the folded position, the user must first remove the locking member 23 and force the supporting leg frame 20 to rotate towards the panel 2 that will pivotally move the supporting leg frame 20 along the folding channel 11 from the unfolded position to the folded position. However, in order to pivotally move the supporting leg frame 20 along the folding channel, a pressing force has to be applied to the supporting legs 211 so that the distance between them should be at least equal to the width of the retaining portion 112 of the folding channel 11.

It is worth mentioning that if a plurality of foldable panel supporters is utilized to support the panel 2 at an elevated level, while in folded position, the respective supporting leg frames 20 of the foldable panel supporters 1 can be arranged to be overlappedly folded in position in order to form a compact structure as depicted in FIG. 4B of the drawings. Conversely, the supporting leg frames 20 can be completely unfolded to support the panel and stand on a ground, as depicted in FIGS. 1 and 4A of the drawings.

From the forgoing analysis, one skilled in the arts should appreciate that the following features of the present invention should be identified. First, one should realize that the weight of the supporting legs frame 20 is minimized for a given size of a leg frame, because the supporting leg frame 20 of the present invention is essentially constructed by bending of a constituent elongated member.

Besides, when a plurality of foldable panel supporters 1 is utilized and the supporting leg frames 20 are folded as depicted in FIG. 4B of the drawings, the panel 2 can be, to the preference of the user, hanged at an elevated position, instead of standing on the ground as in the case of conventional foldable tables, in order to keep it out of reach of children to prevent accident should they accidentally tripped by the supporting leg frame 20. In addition, this feature offers the user of the present invention a more flexible way of storing the panel.

Furthermore, the supporting leg frame 20 of the foldable panel supporter 1 is arranged to be diagonally folded and unfolded with respect to the panel by which it supports, as a result, the length of the supporting leg frame 20 can be maximized. In other words, there is no need to unnecessarily increase the area of the panel in order to merely increase the length of the supporting leg frame 20 (thus the height of the panel being supported at).

On top of that, the foldable panel supporter 1 of the present invention can be detachably mounted on the panel 2, and as a result, adapts to panels of a variety of shapes and sizes. And of course, in relation to this feature, supporting leg frames of different lengths can be utilized to suit the need of individual users of the present invention.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A foldable panel supporter, comprising:

a supporting leg frame which comprises a lower supporting frame and an upper connecting frame, wherein said upper connecting frame comprises a pair of resilient connecting arms adapted for being inwardly pressed to reduce a distance between said two connecting arms;

a supporter joint which has a folding channel provided thereon, wherein said folding channel has two holding portions at two ends thereof and a retaining portion extending between said two holding portions, wherein said retaining portion has a width narrower than said two holding portions, wherein each of said holding portions is shaped and sized to receive said connecting arms therein, wherein by slightly and inwardly pressing said connecting arms to an extent that a distance between said connecting arms is equal to said width of said retaining portion, said upper supporting frame is capable of sliding from one of said holding portions to another said holding portion; and means for retaining said upper connecting frame in said folding channel of said supporting joint in a pivotally foldable manner so as to pivotally connect said supporting leg frame with said supporting joint together, wherein said retaining portion which is narrower than said holding portions of said folding channel prevents said upper connecting frame of said supporting leg frame from sliding back from one of said holding portion to another said holding portion along said folding channel unless a compression force is applied to move said two connecting arms together, wherein said folding channel is defined between two arc-shaped side walls of said supporter joint, wherein middle portions of said two side walls are closest with each other so as to define a narrowest mid-portion of said retaining portion which two ends gradually increases a width thereof to said two holding portions to form said folding channel, wherein when said two connecting arms is positioned at one of said holding portions, said supporting leg frame is retained in position because said two arc-shaped side walls substantially prevent said two connecting arms from moving towards said retaining portion unless said upper connecting frame is pressed to move from one of said holding portions to another said holding portion along said folding channel, wherein said two connecting arms are being pressed towards each other by said two arc-shaped side walls while passing through said retaining portion.

2. The foldable panel supporter, as recited in claim 1, wherein said retaining means has two holding holes formed at two outer sides of said supporter joint and each of said connecting arms has a L-shape that comprises a longitudinal portion and a transverse portion transversely, integrally and outwardly extended from said longitudinal portion, wherein said two transverse portions of said two connecting arms inserted in said two holding holes respectively so as to pivotally mount said supporting leg frame on said supporter joint.

3. A foldable panel supporter, comprising:

a supporting leg frame which comprises a lower supporting frame and an upper connecting frame, wherein said upper connecting frame comprises a pair of resilient connecting arms adapted for being inwardly pressed to reduce a distance between said two connecting arms;

a supporter joint which has a folding channel provided thereon, wherein said folding channel has two holding portions at two ends thereof and a retaining portion extending between said two holding portions, wherein said retaining portion has a width narrower than said two holding portions, wherein each of said holding portions is shaped and sized to receive said connecting arms therein, wherein by slightly and inwardly pressing said connecting arms to an extent that a distance between said connecting arms is equal to said width of said retaining portion, said upper supporting frame is capable of sliding from one of said holding portions to another said holding portion; and means for retaining said upper connecting frame in said folding channel of said supporting joint in a pivotally foldable manner so as to pivotally connect said supporting leg frame with said supporting joint together, wherein said retaining portion which is narrower than said holding portions of said folding channel prevents said upper connecting frame of said supporting leg frame from sliding back from one of said holding portion to another said holding portion along said folding channel unless a compression force is applied to move said two connecting arms together, wherein a distance between said two connecting arms before said upper connecting frame is retained in said folding channel is slightly wider than a width of each of said holding portions, wherein after said two connecting arms of said upper connecting frame are retained at one of said holding portions, said two connecting arms are pressed towards each other and, on the other hand, said two connecting arms press against two ends of said holding portion that helps to retain said upper connecting frame at said holding portion, wherein said folding channel is defined between two arc-shaped side walls of said supporter joint, wherein middle portions of said two side walls are closest with each other so as to define a narrowest mid-portion of said retaining portion which two ends gradually increases a width thereof to said two holding portions to form said folding channel, wherein when said two connecting arms is positioned at one of said holding portions, said supporting leg frame is retained in position because said two arc-shaped side walls substantially prevent said two connecting arms from moving towards said retaining portion unless said upper connecting frame is pressed to move from one of said holding portions to another said holding portion along said folding channel, wherein said two connecting arms are being pressed towards each other by said two arc-shaped side walls while passing through said retaining portion.

4. The foldable panel supporter, as recited in claim 3, wherein said retaining means has two holding holes formed at two outer sides of said supporter joint and each of said connecting arms has a L-shape that comprises a longitudinal portion and a transverse portion transversely, integrally and outwardly extended from said longitudinal portion, wherein said two transverse portions of said two connecting arms inserted in said two holding holes respectively so as to pivotally mount said supporting leg frame on said supporter joint.

5. The foldable panel supporter, as recited in claim 4, further comprising a locking member to be attached on said supporting leg frame to restrict any inward movement of said two connecting arms so as to lock said upper connecting frame at one of said holding portions in position.

6. A foldable panel supporter, comprising:

a supporting leg frame which comprises a lower supporting frame and an upper connecting frame, wherein said upper connecting frame comprises a pair of resilient connecting arms adapted for being inwardly pressed to reduce a distance between said two connecting arms;

a supporter joint which has a folding channel provided thereon, wherein said folding channel has two holding portions at two ends thereof and a retaining portion extending between said two holding portions, wherein said retaining portion has a width narrower than said two holding portions, wherein each of said holding portions is shaped and sized to receive said connecting arms therein, wherein by slightly and inwardly pressing said connecting arms to an extent that a distance between said connecting arms is equal to said width of said retaining portion, said upper supporting frame is capable of sliding from one of said holding portions to another said holding portion; and means for retaining said upper connecting frame in said folding channel of said supporting joint in a pivotally foldable manner so as to pivotally connect said supporting leg frame with said supporting joint together, wherein said retaining portion which is narrower than said holding portions of said folding channel prevents said upper connecting frame of said supporting leg frame from sliding back from one of said holding portion to another said holding portion along said folding channel unless a compression force is applied to move said two connecting arms together, wherein said supporter joint has a receiving cavity which communicates with outside through said folding channel, wherein said upper connecting frame is received in said receiving cavity through said folding channel, wherein a distance between said two connecting arms before said upper connecting frame is inserted in said receiving cavity through said folding channel is slightly wider than a width of each of said holding portions, wherein after said two connecting arms of said upper connecting frame are retained at one of said holding portions, said two connecting arms are pressed towards each other and, on the other hand, said two connecting arms press against two ends of said holding portion that helps to retain said upper connecting frame at said holding portion, wherein said folding channel is defined between two arc-shaped side walls of said supporter joint, wherein middle portions of said two side walls are closest with each other so as to define a narrowest mid-portion of said retaining portion which two ends gradually increases a width thereof to said two holding portions to form said folding channel, wherein when said two connecting arms is positioned at one of said holding portions, said supporting leg frame is retained in position because said two arc-shaped side walls substantially prevent said two connecting arms from moving towards said retaining portion unless said upper connecting frame is pressed to move from one of said holding portions to another said holding portion along said folding channel, wherein said two connecting arms are being pressed towards each other by said two arc-shaped side walls while passing through said retaining portion.

7. The foldable panel supporter, as recited in claim 6, wherein each of said connecting arms has a L-shape that comprises a longitudinal portion and a transverse portion transversely, integrally and outwardly extended from said longitudinal portion, wherein said retaining means has two holding holes formed at two outer sides of said supporter joint and communicated with said receiving cavity, wherein said transverse portion of said connecting arms are arranged to extend out of said supporter joint through said two holding holes respectively so as to pivotally mount said supporting leg frame on said supporter joint.

8. The foldable panel supporter, as recited in claim 7, further comprising a locking member to be attached on said supporting leg frame to restrict any inward movement of said two connecting arms so as to lock said upper connecting frame at one of said holding portions in position.

9. A panel support arrangement, comprising:

a panel of a predetermined shape and size; and a plurality of foldable panel supporters each of which comprises:

a supporting leg frame which comprises a lower supporting frame and an upper connecting frame, wherein said upper connecting frame comprises a pair of resilient connecting arms adapted for being inwardly pressed to reduce a distance between said two connecting arms;

a supporter joint, which is affixed to a bottom surface of said panel, having a folding channel provided thereon, wherein said folding channel has a first holding portion and a second holding portion at two ends thereof and a retaining portion extending between said first and second holding portions, wherein said retaining portion has a width narrower than said first and second holding portions, wherein each of said first and second holding portions is shaped and sized to receive said connecting arms therein, wherein by slightly and inwardly pressing said connecting arms to an extent that a distance between said connecting arms is equal to said width of said retaining portion, said upper supporting frame is capable of sliding either from said first holding portion to said second holding portion or from said second holding portion to said first holding portion; and means for retaining said upper connecting frame in said folding channel of said supporting joint in a pivotally foldable manner so as to pivotally connect said supporting leg frame with said supporting joint together, wherein when said upper connecting frame is retained at said first holding portion, said supporting leg frame is extended perpendicularly from said panel and retained in an unfolded position, wherein when said upper connecting frame is retained at said second holding portion, said supporting leg frame is overlapped with said panel and retained in a folded position, wherein said retaining portion which is narrower than said first and second holding portions of said folding channel prevents said upper connecting frame of said supporting leg frame from sliding back from one of said first and second holding portions to another of said first and second holding portions along said folding channel unless a compression force is applied to move said two connecting arms together, wherein each of said folding channels is defined between two arc-shaped side walls of said supporter joint, wherein middle portions of said two side walls are closest with each other so as to define a narrowest mid-portion of said retaining portion which two ends gradually increases a width thereof to said two holding portions to form said folding channel, wherein when said two connecting arms is positioned at one of said holding portions, said supporting leg frame is retained in position because said two arc-shaped side walls substantially prevent said two connecting arms from moving towards said retaining portion unless said upper connecting frame is pressed to move from one of said holding portions to another said holding portion along said folding channel, wherein said two connecting arms are being pressed towards each other by said two arc-shaped side walls while passing through said retaining portion.

10. The panel support arrangement, as recited in claim 9, wherein each of said retaining means has two holding holes formed at two outer sides of said supporter joint and each of said connecting arms has a L-shape that comprises a longitudinal portion and a transverse portion transversely, integrally and outwardly extended from said longitudinal portion, wherein said two transverse portions of said two connecting arms inserted in said two holding holes respectively so as to pivotally mount said supporting leg frame on said supporter joint.

11. A panel support arrangement, comprising:

a panel of a predetermined shape and size; and a plurality of foldable panel supporters each of which comprises:

a supporting leg frame which comprises a lower supporting frame and an upper connecting frame, wherein said upper connecting frame comprises a pair of resilient connecting arms adapted for being inwardly pressed to reduce a distance between said two connecting arms;

a supporter joint, which is affixed to a bottom surface of said panel, having a folding channel provided thereon, wherein said folding channel has a first holding portion and a second holding portion at two ends thereof and a retaining portion extending between said first and second holding portions, wherein said retaining portion has a width narrower than said first and second holding portions, wherein each of said first and second holding portions is shaped and sized to receive said connecting arms therein, wherein by slightly and inwardly pressing said connecting arms to an extent that a distance between said connecting arms is equal to said width of said retaining portion, said upper supporting frame is capable of sliding either from said first holding portion to said second holding portion or from said second holding portion to said first holding portion; and means for retaining said upper connecting frame in said folding channel of said supporting joint in a pivotally foldable manner so as to pivotally connect said supporting leg frame with said supporting joint together, wherein when said upper connecting frame is retained at said first holding portion, said supporting leg frame is extended perpendicularly from said panel and retained in an unfolded position, wherein when said upper connecting frame is retained at said second holding portion, said supporting leg frame is overlapped with said panel and retained in a folded position, wherein said retaining portion which is narrower than said first and second holding portions of said folding channel prevents said upper connecting frame of said supporting leg frame from sliding back from one of said first and second holding portions to another of said first and second holding portions along said folding channel unless a compression force is applied to move said two connecting arms together, wherein a distance between said two connecting arms of each of said upper connecting frames before said upper connecting frame is retained in said folding channel is slightly wider than a width of each of said holding portions, wherein after said two connecting arms of said upper connecting frame are retained at one of said holding portions, said two connecting arms are pressed towards each other and, on the other hand, said two connecting arms press against two ends of said holding portion that helps to retain said upper connecting frame at said holding portion, wherein said folding channel is defined between two arc-shaped side walls of said supporter joint, wherein middle portions of said two side walls are closest with each other so as to define a narrowest mid-portion of said retaining portion which two ends gradually increases a width thereof to said two holding portions to form said folding channel, wherein when said two connecting arms is positioned at one of said holding portions, said supporting leg frame is retained in position because said two arc-shaped side walls substantially prevent said two connecting arms from moving towards said retaining portion unless said upper connecting frame is pressed to move from one of said holding portions to another said holding portion along said folding channel, wherein said two connecting arms are being pressed towards each other by said two arc-shaped side walls while passing through said retaining portion.

12. The panel support arrangement, as recited in claim 11, wherein each of said retaining means has two holding holes formed at two outer sides of said supporter joint and each of said connecting arms has a L-shape that comprises a longitudinal portion and a transverse portion transversely, integrally and outwardly extended from said longitudinal portion, wherein said two transverse portions of said two connecting arms inserted in said two holding holes respectively so as to pivotally mount said supporting leg frame on said supporter joint.

13. The foldable panel supporter, as recited in claim 12, further comprising a locking member to be attached on said supporting leg frame to restrict any inward movement of said two connecting arms so as to lock said upper connecting frame at one of said holding portions in position.

14. A panel support arrangement, comprising:

a panel of a predetermined shape and size; and a plurality of foldable panel supporters each of which comprises:

a supporting leg frame which comprises a lower supporting frame and an upper connecting frame, wherein said upper connecting frame comprises a pair of resilient connecting arms adapted for being inwardly pressed to reduce a distance between said two connecting arms;

a supporter joint, which is affixed to a bottom surface of said panel, having a folding channel provided thereon, wherein said folding channel has a first holding portion and a second holding portion at two ends thereof and a retaining portion extending between said first and second holding portions, wherein said retaining portion has a width narrower than said first and second holding portions, wherein each of said first and second holding portions is shaped and sized to receive said connecting arms therein, wherein by slightly and inwardly pressing said connecting arms to an extent that a distance between said connecting arms is equal to said width of said retaining portion, said upper supporting frame is capable of sliding either from said first holding portion to said second holding portion or from said second holding portion to said first holding portion; and means for retaining said upper connecting frame in said folding channel of said supporting joint in a pivotally foldable manner so as to pivotally connect said supporting leg frame with said supporting joint together, wherein when said upper connecting frame is retained at said first holding portion, said supporting leg frame is extended perpendicularly from said panel and retained in an unfolded position, wherein when said upper connecting frame is retained at said second holding portion, said supporting leg frame is overlapped with said panel and retained in a folded position, wherein said retaining portion which is narrower than said first and second holding portions of said folding channel prevents said upper connecting frame of said supporting leg frame from sliding back from one of said first and second holding portions to another of said first and second holding portions along said folding channel unless a compression force is applied to move said two connecting arms together, wherein each of said supporter joints has a receiving cavity which communicates with outside through said folding channel, wherein said upper connecting frame is received in said receiving cavity through said folding channel, wherein a distance between said two connecting arms of each of said upper connecting frames before said upper connecting frame is retained in said folding channel is slightly wider than a width of each of said holding portions, wherein after said two connecting arms of said upper connecting frame are retained at one of said holding portions, said two connecting arms are pressed towards each other and, on the other hand, said two connecting arms press against two ends of said holding portion that helps to retain said upper connecting frame at said holding portion, wherein said folding channel is defined between two arc-shaped side walls of said supporter joint, wherein middle portions of said two side walls are closest with each other so as to define a narrowest mid-portion of said retaining portion which two ends gradually increases a width thereof to said two holding portions to form said folding channel, wherein when said two connecting arms is positioned at one of said holding portions, said supporting leg frame is retained in position because said two arc-shaped side walls substantially prevent said two connecting arms from moving towards said retaining portion unless said upper connecting frame is pressed to move from one of said holding portions to another said holding portion along said folding channel, wherein said two connecting arms are being pressed towards each other by said two arc-shaped side walls while passing through said retaining portion.

15. The panel support arrangement, as recited in claim 14, wherein each of said connecting arms has a L-shape that comprises a longitudinal portion and a transverse portion transversely, integrally and outwardly extended from said longitudinal portion, wherein said retaining means has two holding holes formed at two outer sides of said supporter joint and communicated with said receiving cavity, wherein said transverse portion of said connecting arms are arranged to extend out of said supporter joint through said two holding holes respectively so as to pivotally mount said supporting leg frame on said supporter joint.

16. The foldable panel supporter, as recited in claim 15, further comprising a locking member to be attached on said supporting leg frame to restrict any inward movement of said two connecting arms so as to lock said upper connecting frame at one of said holding portions in position.

* * * * *